US005775084A

United States Patent [19]

Bernhardy

[11] Patent Number: 5,775,084

[45] Date of Patent: Jul. 7, 1998

[54] RECYCLABLE STRING

[75] Inventor: Robert K. Bernhardy, 21 Cindy Pl., Brentwood, Calif. 94513

[73] Assignee: Robert K. Bernhardy, Brentwood, Calif.

[21] Appl. No.: 638,529

[22] Filed: Apr. 26, 1996

Related U.S. Application Data

[63] Continuation-in-part of Ser. No. 388,379, Feb. 14, 1995, abandoned.

[51] Int. Cl.[6] ..... D02G 3/02; D02G 3/06

[52] U.S. Cl. ..... 57/260; 57/31; 57/310; 264/103; 264/288.4

[58] Field of Search ..... 57/260, 287, 288, 57/31, 310; 264/288.4, 103

[56] References Cited

U.S. PATENT DOCUMENTS

| | | | |
|---|---|---|---|
| 974,132 | 11/1910 | Funke . | |
| 2,403,317 | 7/1946 | Warren, Jr. | 57/140 |
| 2,453,984 | 11/1948 | Gardner | 57/157 |
| 2,545,869 | 3/1951 | Bailey | 18/8 |
| 2,602,283 | 7/1952 | Hall | 57/31 |
| 3,327,468 | 6/1967 | Page | 57/140 |
| 3,332,228 | 7/1967 | Chill | 57/155 |
| 3,475,894 | 11/1969 | Wilke et al. | 264/103 |
| 3,553,305 | 1/1971 | Au | 264/210 |
| 3,574,811 | 4/1971 | Jamison | 264/184 |
| 3,752,457 | 8/1973 | Parmeggiani | 264/210 |
| 3,839,524 | 10/1974 | Adams | 264/131 |
| 3,894,135 | 7/1975 | Riggert | 264/290 |
| 3,943,138 | 3/1976 | Marshall | 264/290 |
| 4,164,530 | 8/1979 | Renjilian | 264/103 |
| 4,350,006 | 9/1982 | Okamoto | 57/250 |
| 4,668,577 | 5/1987 | Ohta | 428/364 |

*Primary Examiner*—William Stryjewski

[57] ABSTRACT

Recyclable string and methods and apparatus for making the same are disclosed. The recyclable string is made by the disclosed apparatus from a strip of recyclable stretch film by twisting the stretch film about its longitudinal axis and stretching the twisted stretch film along its longitudinal axis, preventing the untwisting of the twisted stretch film. In a second version the srip is not twisted.

8 Claims, 3 Drawing Sheets

RECYCLABLE STRING

This application is a C-I-P of Ser. No. 08/388,379, filed Feb. 14, 1995, which is abandoned.

BACKGROUND OF THE INVENTION

1. Field of the Invention

My present invention relates to string, and more particularly to string made from recyclable material, and methods and apparatus for making the same.

2. Description of the Prior Art

Stretching processes and apparatus for producing polyester cables, yarns, textile fibers, polyfilamentous plastic strand, and the like, are known in the prior art.

U.S. Pat. No. 3,894,135, issued to Karlheinz Riggert, et al., on Jul. 8, 1975, and entitled PROCESS FOR STRETCHING A CABLE OF POLYESTER THREADS, discloses a process for stretching a cable of polyester threads, especially a cable of polyethylene terephthalate, between an inlet roller mechanism, and a first stretching roller mechanism, in which the cable is conducted, within the lateral roller mechanism, through an immersion bath maintained at a temperature between 40° and 65° Celsius.

U.S. Pat. No. 3,943,138, issued to Geoffrey Marshall and Eric Ivan Riseley on Mar. 9, 1976, and entitled PROCESS FOR UNIFORMLY DRAWING POLYETHYLENE TEREPHTHALATE FILAMENTS TO FORM HIGH SHRINKAGE FIBERS, discloses a process for uniformly drawing tows of polyethylene terephthalate to produce high shrinkage fibers wherein the drawing is effected with the tow in a hot water saturated condition at a controlled birefringence, temperature and draw ratio.

These prior art stretching processes, however, involve the careful maintenance of certain parameters of the stretched strands and their environments, such as temperature, birefringence, and draw ratio.

Further, the processes of these patents involve the handling of multiplicities of fibers in the form of cables or tows of filaments.

It is believed that the United States patents listed immediately hereinbelow contain information which is or might be considered to be material to the examination of this patent application.

U.S. Pat. No. 3,553,305
U.S. Pat. No. 3,574,811
U.S. Pat. No. 3,752,457
U.S. Pat. No. 3,839,524
U.S. Pat. No. 4,350,006
U.S. Pat. No. 4,668,577
U.S. Pat. No. 4,164,530
U.S. Pat. No. 3,457,894
U.S. Pat. No. 3,332,228
U.S. Pat. No. 3,327,468
U.S. Pat. No. 2,602,283
U.S. Pat. No. 2,545,869
U.S. Pat. No. 2,453,984
U.S. Pat. No. 2,403,317
U.S. Pat. No. 974,132

The term "prior art" as used herein or in any statement made by or on behalf of applicant means only that any document or thing referred to as prior art bears, directly or inferentially, a date which is earlier than the effective filing date hereof.

No representation is made that any of the above-listed United States patents is part of the prior art, or that no more pertinent information exists.

A copy of each of the United States patents referred to hereinabove is being supplied to the United States Patent and Trademark Office herewith, except those copied with the parent application.

SUMMARY OF THE INVENTION

Accordingly, it is an object of my present invention to provide string which is fabricated from recyclable material, e.g., polyethylene film.

Another object of my present invention is to provide string which is fabricated substantially entirely from recyclable material.

Yet another object of my present invention is to provide strings which are fabricated from recyclable material, each of which strings is fabricated from a single, continuous strip of said recyclable material.

A further object of my present invention is to provide processes for fabricating strings from recyclable material, each of which strings is fabricated from a single, continuous strip of said recyclable material.

A yet further object of my present invention is to provide processes which achieve the preceding object and which do not involve the careful maintenance of critical process parameters, such as temperature, birefringence, draw ratio and the like.

A yet further object of my present invention is to provide processes which achieve at least some of the preceding objects and which do not involve the careful maintenance of critical process parameters, such as temperature, birefringence, draw ratio and the like, and in some embodiments do not involve the twisting of said continuous strip.

Another object of my present invention is to provide apparatus for fabricating strings from recyclable material, each of which strings is fabricated from a single, continuous strip of said recyclable material.

Yet another object of my present invention is to provide apparatus which achieves at least one of the preceding objects and which is devoid of means for determining and controlling particular parameters of said strip of recyclable material, such as temperature, birefringence, tow ratio, and the like.

A further object of my present invention is to provide apparatus which achieves the two preceding objects, which apparatus is devoid of means for determining and controlling parameters of the media surrounding parts of said strip of recyclable material, such as temperature, humidity, and the like.

Other objects of my present invention will in part be obvious and will in part appear hereinafter.

My present invention, accordingly comprises the several steps and the relations of one or more of such steps with respect to each of the others, the apparatus embodying features of construction, combinations of elements and arrangements of parts, and the articles having certain characteristics and properties, all as exemplified in the detailed disclosure hereinafter set forth, including the drawings, and the scope of my present invention will be indicated in the claims appended hereto.

In accordance with a principal feature of my present invention strings are fabricated from continuous strips of recyclable material.

In accordance with another principal feature of my present invention each such string is fabricated from a single, continuous strip of recyclable material, e.g., polyethylene stretch film.

In accordance with an additional principal feature of my present invention certain strings thereof are each comprised of a plurality of said continuous strips of recyclable material.

In accordance with yet another principal feature of my present invention each such string is fabricated by continuously twisting the strip of recyclable material from which it is fabricated about its longitudinal axis until its maximum transverse dimension is no more than three times as great as its minimum transverse dimension.

In accordance with a principal feature of a second preferred embodiment of my present invention each string is fabricated substantially without continuously twisting the strip of recyclable material from which it is fabricated about its longitudinal axis.

In accordance with a yet further principal feature of my present invention apparatus for fabricating said strings is comprised of a payout reel for paying out a strip of recyclable material and rotating means for rotating said payout reel about an axis perpendicular to its axis of rotation, said payout reel being mounted in said rotating means on a roller bearing supported shaft, so that said payout reel can be freely manually rotated in said rotating means. The paying out of said film strip, however, being braked by the electrostatic cling property of said film.

In accordance with a yet further principal feature of said second preferred embodiment of my present invention apparatus for fabricating said strings is comprised of a payout reel for paying out a strip of recyclable material and no rotating means for rotating said payout reel about an axis perpendicular to its axis of rotation, said payout reel being mounted in said rotating means on a roller bearing supported shaft, so that said payout reel can be freely manually rotated in said rotating means. The paying out of said film strip, however, being braked by the electrostatic cling property of said film.

In accordance with another principal feature of my present invention said apparatus for fabricating said string is further comprised of a motor-driven takeup reel for taking up said string after its fabrication is completed.

In accordance with yet another principal feature of my present invention said apparatus for fabricating said string is further comprised of drag braking means for frictionally opposing the taking up of said twisted strip onto said takeup reel, thus stretching said twisted strip beyond its elastic limit but below its breaking limit.

In accordance with yet another principal feature of said second preferred embodiment of my present invention said apparatus for fabricating said string is further comprised of drag braking means for frictionally opposing the taking up of the stretched but substantially untwisted strip onto said takeup reel, thus stretching said stretched but substantially untwisted strip beyond its elastic limit but below its breaking limit so that mutually confronting portions thereof bond together.

For a fuller understanding of the nature and objects of the present invention, reference should be had to the following detailed description, taken in connection with the accompanying drawings.

DESCRIPTION OF THE PREFERRED EMBODIMENTS

Figure 1:
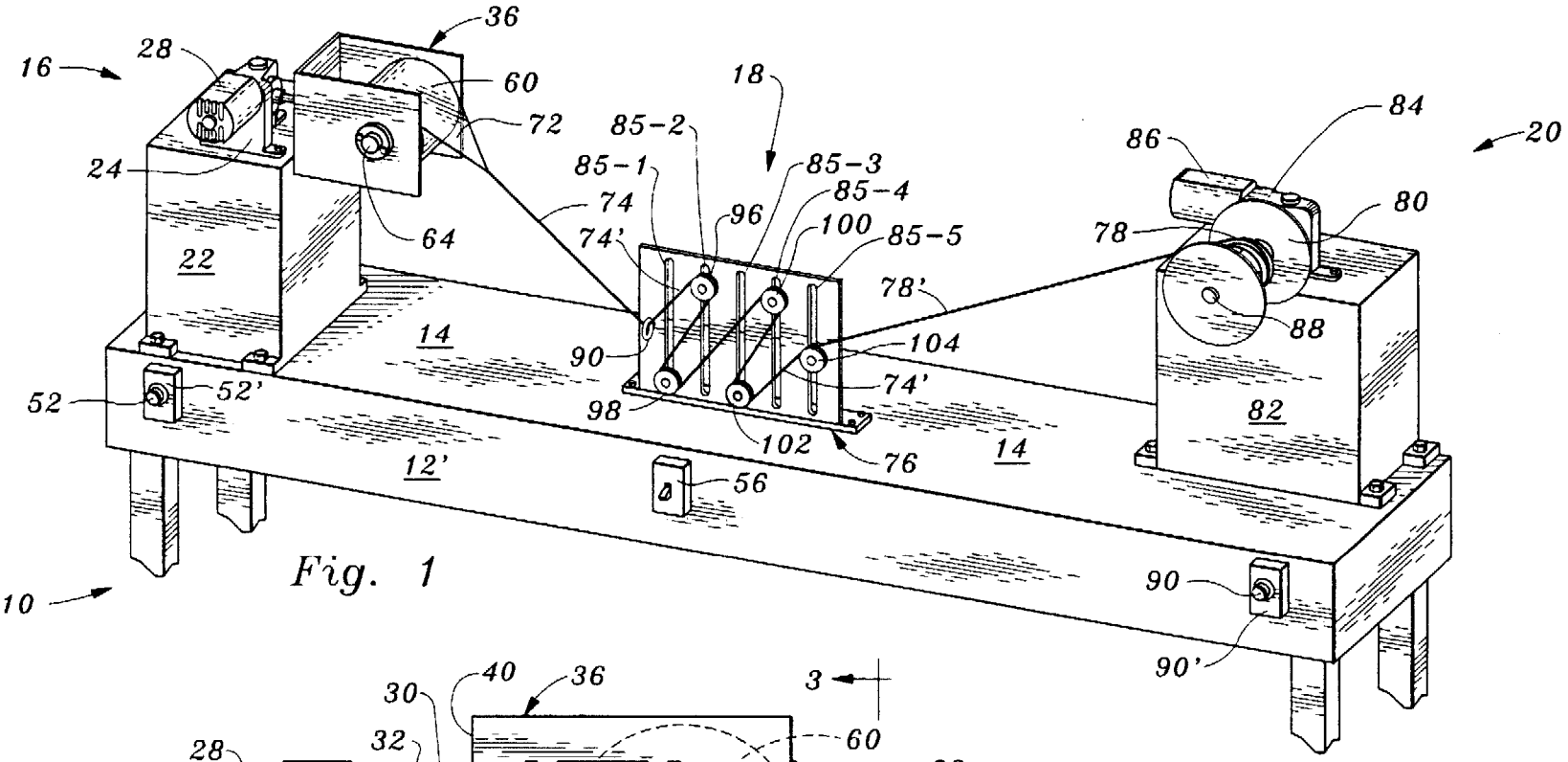
FIG. 1 is a perspective view of a string fabricating device of the present invention.

Referring now to FIG. 1, there is shown a recyclable string fabricating device 10 of the first preferred embodiment of my present invention.

String fabricating device 10 comprises a table 12 having a flat top 14.

As further seen in FIG. 1, string fabricating device 10 is comprised of a payout reel section 16, a drag brake section 18, and a takeup reel section 20, all of which are disposed upon table top 14 and secured to table 12.

Figure 2:
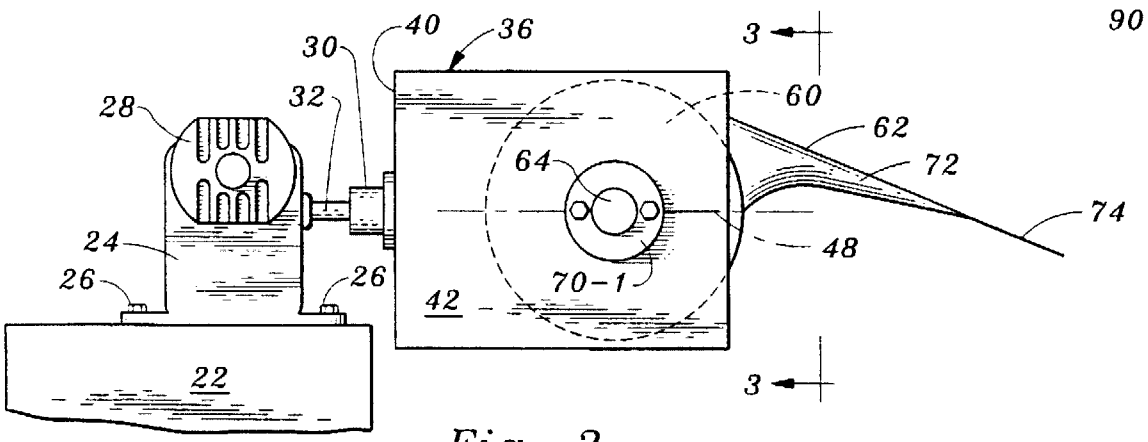
FIG. 2 is an elevational view of the payout reel section of the string fabricating device shown in FIG. 1.

As may best be seen by comparison of FIGS. 1 and 2, payout reel section 16 is comprised of a pedestal 22 which is affixed to table 12 and disposed upon top 14 thereof.

A gear reducer 24 is affixed to the top of pedestal 22 by means of bolts 26 (FIG. 2).

The housing of an electric motor 28 is affixed to the housing of gear reducer 24, and the output shaft of motor 28 is affixed to the input coupling of gear reducer 24.

As also seen in FIG. 2, a boss 30 is mounted upon and irrotatably affixed to the output shaft 32 of gear reducer 24.

Figure 3:
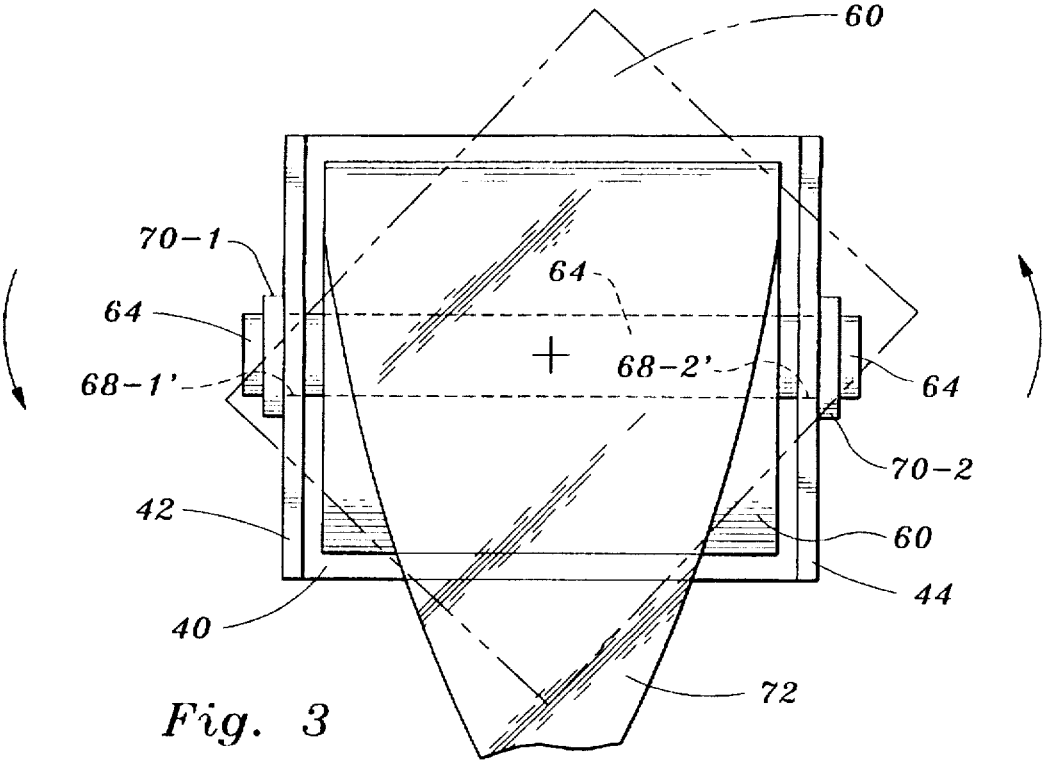
FIG. 3 is an elevational view of the payout reel of the string fabricating device of the present invention shown in FIG. 1.

As may best be seen by comparison of FIGS. 2 and 3, a unitary saddle 36 comprised of a base plate 40 and two side plates 42, 44 is affixed to boss 30 in such manner that saddle 36 rotates about output shaft axis 48 whenever gear reducer output shaft 32 rotates, and in synchronism therewith.

Thus, as will be evident to those having ordinary skill in the art, informed by the present disclosure, saddle 36 rotates about output shaft axis 48 whenever the output shaft of electric motor 28 is rotating, the ratio between the speed of rotation of the output shaft of electric motor 28 and the speed of rotation of saddle 36 about output shaft axis 48 being determined by the internal construction of gear reducer 24 in the manner well known to those having ordinary skill in the art.

Referring again to FIG. 1, it will be seen that a knob 52 and its cooperating facia plate 52' are mounted on the skirt flange 12' of table 12 adjacent payout reel section 16.

Speed selection knob 52 is the speed selection knob of an electric motor controller of well known type which is not shown in the present drawings because such electric motor speed controllers are well known to those having ordinary skill in the art.

In the manner known to those having ordinary skill in the art the electric motor controller of which speed selection knob 52 is a part is connected between the input terminals of electric motor 28 and the output terminals of a manually operable electric switch 56 (FIG. 1), which is itself mounted on skirt flange 12'.

It is to be understood that the input terminals of switch 56 are themselves connected to a suitable source of electrical power.

Thus, it will be evident to those having ordinary skill in the art, informed by the present disclosure, that electric motor 28 may be energized or deenergized by manually manipulating switch 56, and that when electric motor 28 is energized the speed of electric motor 28 may be varied by manually turning knob 52.

It follows, then, that when the manual actuator of switch 56 is in its ON position the speed of rotation of saddle 36 about axis 48 may be determined by suitable manipulation of speed selection knob 52 (FIG. 1).

Referring again to FIGS. 2 and 3, and comparing the same, it will be seen that a roll 60 of recyclable film strip 62, e.g., a strip of 5 inch wide by one mil (0.001 inch) thick polyethylene stretch film, is contained within saddle 36 and is rotatably mounted on a shaft 64 the respective ends of which are located in bores 68-1', 68-2', which pass through side plate 42 and side plate 44, respectively. Strip film 62 is sometimes called "banding film" or "linear film".

Shaft 64 is maintained in bores 68-1' and 68-2' by means of demountable retainers 70-1, 70-2 (FIG. 3).

Comparing FIGS. 1, 2 and 3 it will be seen that, in the first prefered embodiment, as recyclable film strip 62 is drawn from roll 60 and toward brake section 18 it first passes through constriction zone 72 wherein it is twisted into an unbonded twist 74. Unbonded twist 74 then passes into drag brake section 18, wherein it is stretched and its diameter is considerably reduced (compare FIGS. 6 and 7). (The part of twist 74 within brake 18 is designated by the reference numeral 74'.)

It is further to be understood that in the second preferred embodiment motor 28 is not energized, or saddle 36 is not rotatable about axis 48, and thus strip 62 is not twisted.

As best seen in FIG. 1, the reduced twist 78' which emerges from drag brake 18 proceeds directly to reel 80 of takeup reel section 20 and is then wound on takeup reel 80, thus stretching the span of reduced twist 78' between brake section 18 and takeup reel 80 beyond its elastic limit but well below its breaking limit, whereby untwisting of the resulting string 78 wound on takeup reel 80 is prevented.

As will now be clear to those having ordinary skill in the art, informed by the present disclosure, in the first preferred embodiment, film strip 62 is continuous, passing from roll 60 in saddle 36 to takeup reel section 20, where it is reeled onto takeup reel 80 (FIGS. 1 and 5) as finished string 78, whereas in the second preferred embodiment, the same strip film processing steps take place but strip 62 is not twisted.

It will also be seen that film strip 62 changes form at various stages of its passage through strip fabricating device 10, whether twisted or not. For example, when film strip 62 is twisted about its longitudinal axis during its passage through constriction zone 72, and thus becomes unbonded twist 74. Unbonded twist 74 then passes through brake section 18, wherein it is designated by the reference numeral 74' (FIG. 4), and then is reeled onto takeup reel 80 as string 78, which is the output product of string fabricating device 10.

Figure 4:
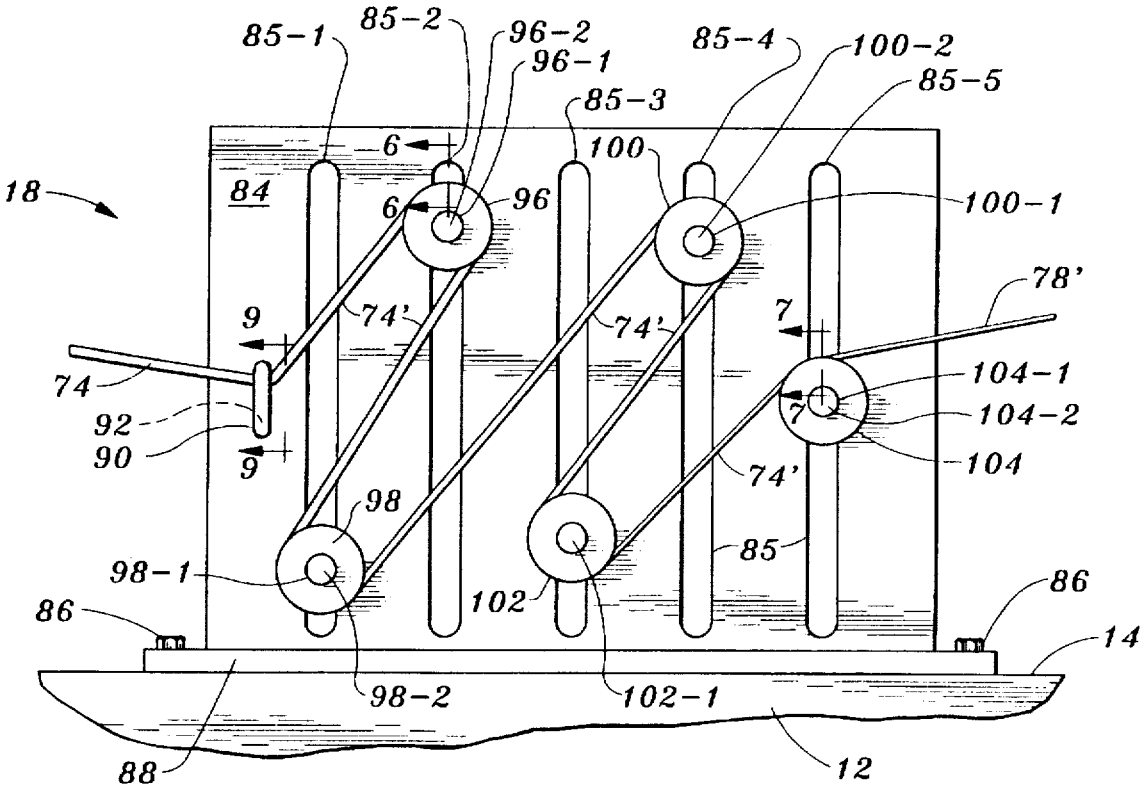
FIG. 4 is an elevational view of the drag brake assembly of the string fabricating device of the present invention shown FIG. 1.

Referring now to FIG. 4, it will be seen that brake section 18 is comprised of a mounting plate 84 upon which are mounted a plurality of processing elements, such as eyes and pulleys, which will be described in detail hereinafter.

Brake section 18 is substantially unchanged in the second preferred embodiment.

As also seen in FIG. 4, mounting plate 84 is fixedly mounted on the flat top 14 of table 12 by means of bolts 86 which pass through suitable cooperating bores in a baseplate 88 which is itself affixed to the lower edge of mounting plate 84, as by welding.

Figure 9:
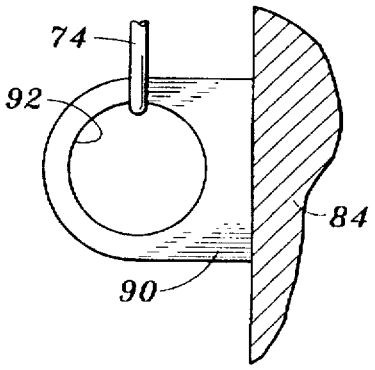
FIG. 9 an elevational view, partly in section, of the eye of the drag brake assembly shown in FIG. 4.

Comparing FIGS. 4 and 9, it will be seen that an eye 90 is fixedly mounted on mounting plate 84, and that eye 90 defines an aperture 92 through which unbonded twist 74 passes.

As shown by dashed lines in FIG. 4, aperture 92 has a smooth toroidal wall the upper part of which is contacted by unbonded twist 74 in passing through aperture 92.

Thus, it will be understood that eye 90 is not intended to catch or frictionally engage twist 74, but rather to guide twist 74 around a fairly sharp corner, and thus to flex twist 74.

Referring again to FIG. 4, it will be seen that a plurality of pulleys 96, 98, 100, 102, 104 are mounted on mounting plate 84. Each of these pulleys is freely, rotatably mounted on mounting plate 84.

More particularly, each pulley 96, 98, 100, 102, 104 is respectively mounted on a roller bearing 96-1, 98-1, 100-1, 102-1, 104-1, and the inner race of each such roller bearing is respectively mounted on a selectively positionable plug 96-2, 98-2, 100-2, 102-2, 104-2 which projects outwardly from mounting plate 84 (as seen in FIG. 4), as by press fitting.

Thus, it will be understood that each pulley 96, 98, 100, 102, 104 is located closely adjacent, but not contacting, the front face (shown in FIG. 4) of mounting plate 84, and is freely rotatable with respect to mounting plate 84, about an axis perpendicular to said front face.

Each of said plugs 96-2, 98-2, 100-2, 102-2, 104-2 is selectively positionable along an associated slot 85-1, 85-2, 85-3, 85-4, 85-5, and is lockable in any desired position along the associated slot, by means the provision of which is within the scope of one having ordinary skill in the art, and thus each pulley 96, 98, 100, 102, 104 is selectively positionable at any desired location on its associated slot.

The collocation of pulleys 96, 98, 100, 102, 104 shown in FIG. 4 is the collocation of the first preferred embodiment of my invention.

At higher takeup reel speeds the drag exerted upon twist 74, 74' should be less than at lower takeup reel speeds, i.e., pulleys 96, 98, 100, 102, 104 should be closer to the horizontal center line of back plate 84, to avoid the breaking of twist 74, 74'.

The segment of film strip 62 which at any particular time is being processed by passing through brake section 18 is herein sometimes designated by the reference numeral 74', and the part of film strip 62 which emerges from brake section 18 over pulley 104 is sometimes designated by the reference numeral 78' herein.

As seen in FIG. 4, segment 74' passes through aperture 92 of eye 90 and is also engaged with the grooves of the respective pulleys 96, 98, 100, 102 and 104, passing over pulley 96, under pulley 98, over pulley 100, under pulley 102, and over pulley 104.

Figure 6:
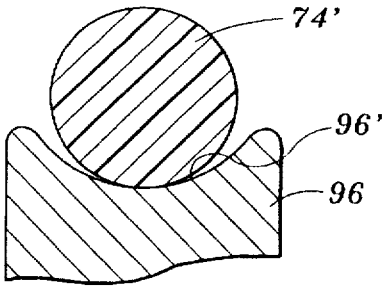
FIG. 6 is a sectional, elevational view of one of the pulleys of the drag brake assembly shown in FIG. 4, taken on plane 6—6 of FIG. 4.
Figure 7:
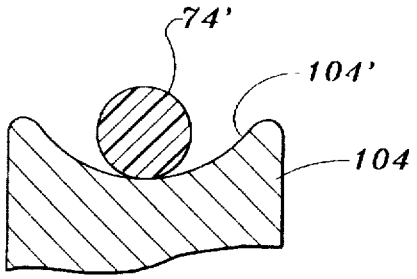
FIG. 7 is a sectional, elevational view of one of the pulleys of the drag brake assembly shown in FIG. 4, taken on plane 7—7 of FIG. 4.

As may be seen from FIGS. 6 and 7, segment 74' is seated in the groove of pulley 96, and is also seated in the groove of pulley 104, as it is seated in the grooves of the other pulleys 98, 100, 102.

As seen in FIG. 6, segment 74' is seated in the groove 96' of pulley 96.

As seen in FIG. 7, segment 74' is seated in the groove 104' of pulley 104.

As may be seen by comparison of FIGS. 6 and 7, segment 74' is reduced in diameter as it passes through braking section 18.

It is to be understood that not all of string 78, or any string produced in accordance with my present invention, is of circular cross-section throughout its length. Generally, however, the maximum dimension of any cross-section of string 78 is no greater than three times the minimum dimension of that cross-section.

Figure 5:
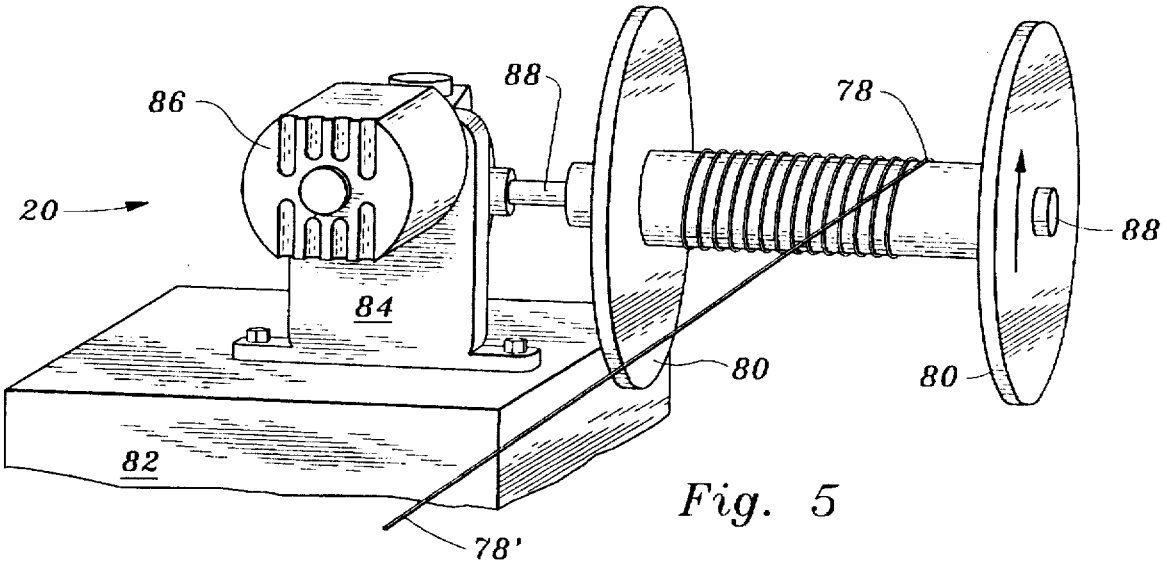
FIG. 5 is an elevational view of the takeup reel section of the string fabricating device of the present invention shown in FIG. 1.

Referring now to FIG. 5, it will be seen that takeup reel section 20 is comprised of a pedestal 82 upon which is mounted a gear reducer 84.

The housing of an electric motor 86 is mounted on the housing of gear reducer 84, and the output shaft of electric motor 86 is affixed to the input coupling of gear reducer 84.

Takeup reel 80 is affixed to the output shaft 88 of gear reducer 84.

As also seen in FIG. 5, the finished string portion 78 of film strip 62 is so affixed to takeup reel 80 as to be wound onto takeup reel 80 when takeup reel 80 is rotated in the clockwise direction as seen in FIG. 5.

It is to be understood that in certain embodiments of my invention takeup reel 80 will be a paper, plastic or metal reel upon which string 78 will subsequently be vended, or retained for later use.

Comparing FIGS. 1 and 5, it will be seen that pedestal 82 is affixed to the top 14 of table 12 in the same manner in which pedestal 22 is affixed to the top 14 of table 12.

As seen in FIG. 1, a knob 90 and its cooperating facia plate 90' are mounted on the skirt flange 12' of table 12 adjacent pedestal 82.

Knob 90 is the speed selection knob of an electric motor controller of well known type, which is not shown in the present drawings because such electric motor speed controllers are well known to those having ordinary skill in the art.

In the manner known to those having ordinary skill in the art, the electric motor controller of which speed selection knob 90 is a part is connected between the input terminals of electric motor 86 and the output terminals of switch 56.

Thus, it will be evident to those having ordinary skill in the art, informed by the present disclosure, that electric motor 86 may be energized or deenergized by manually manipulating switch 56, and that when electric motor 86 is energized the speed of electric motor 86 may be varied by manually turning speed control knob 90.

It follows, then, that when the manual actuator of switch 90 is in its ON position the speed of rotation of takeup reel 80 about the axis of shaft 88 may be determined by suitable manipulation of speed selection knob 90.

In the preferred embodiment of my present invention the speed of rotation of saddle 36 about axis 48 will typically be about 100 revolutions per minute, and the speed of rotation of takeup reel 80 may correspondingly be about 50 to 60 revolutions per minute.

Figure 8:
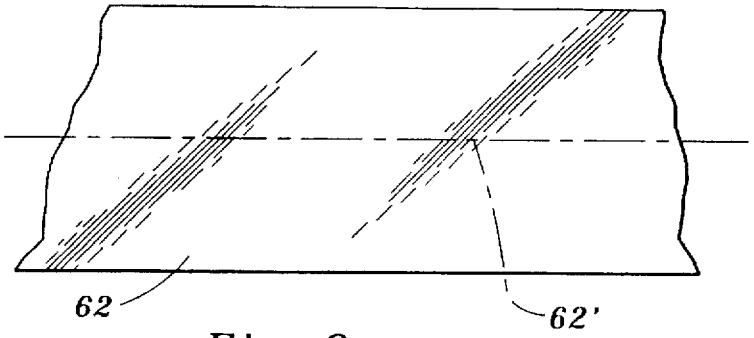
FIG. 8 is a plan view of a strip or ribbon of recyclable material, such as would be used in fabricating string in accordance with the invention, lying on a horizontal surface.

Referring now to FIG. 8, there is shown a segment of stretch film strip 62 and its longitudinal axis 62'. It is to be understood that whenever the term "longitudinal axis" is used herein in connection with stretch film strip 62, or any part thereof, that term is intended to denote a rectilinear axis passing along that stretch film strip and located substantially equidistant from the edges thereof.

It will thus be seen that the objects set forth above, among those made apparent from the preceding description, are efficiently attained, and since certain changes may be made in the above constructions, the method carried out thereby, and the articles made thereby, without departing from the scope of my present invention, it is intended that all matter contained in the above description or shown in the accompanying drawings shall be interpreted as illustrative only, and not in a limiting sense.

It is also to be understood that the following claims are intended to cover all of the generic and specific features of my invention hereindescribed, and all statements of the scope of my invention which, as a matter of language, might be said to fall therebetween.

What is claimed is:

1. A recyclable string formed by a method consisting of the steps formed by:

paying off a recyclable plastic strip from a roll;

passing the strip through an opening smaller than the width;

passing the strip through a braking means which stretches the compacted strip beyond the elastic limit and below the breaking strength limit of the strip to form the string;

taking up the string in a thoroughly stretched condition with circular to oval cross section created by the reduction of the size of the film strip.

2. A recyclable string as claimed in claim 1, in the making of which said strip has been continuously exposed to unheated ambient atmosphere throughout its length.

3. A recyclable string as claimed in claim 1, in which said strip consists essentially of a polyethylene material.

4. A recyclable string as claimed in claim 1, where the maximum dimension of any cross section of the string is no greater than three times the minimum dimension of that cross section.

5. A recyclable string formed by a method consisting of the steps formed by:

paying off a recyclable plastic strip from a roll and twisting the roll to twist the strip about its longitudinal axis;

passing the strip through an opening smaller than the width of the strip to compact strip;

passing the strip through a braking means which stretches the compacted strip beyond the elastic limit and below the breaking strength limit of the strip to form the string;

taking up the string onto a takeup reel in a thoroughly stretched condition with circular to oval cross section created by the reduction of the size of the film strip.

6. A recyclable string as claimed in claim 5, in the making of which said strip has been continuously exposed to unheated ambient atmosphere throughout its length.

7. A recyclable string as claimed in claim 5, in which said strip consists essentially of a polyethylene material.

8. A recyclable string as claimed in claim 5, where the maximum dimension of any cross section of the string is no greater than three times the minimum dimension of that cross section.

* * * * *